US010542598B2

(12) United States Patent
Krajnc et al.

(10) Patent No.: US 10,542,598 B2
(45) Date of Patent: Jan. 21, 2020

(54) LIGHTING CONTROL

(71) Applicant: SIGNIFY HOLDING B.V., Eindhoven (NL)

(72) Inventors: Hugo Jose Krajnc, Eindhoven (NL); Remco Magielse, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 130 days.

(21) Appl. No.: 15/749,917

(22) PCT Filed: Jul. 26, 2016

(86) PCT No.: PCT/EP2016/067803
§ 371 (c)(1),
(2) Date: Feb. 2, 2018

(87) PCT Pub. No.: WO2017/025324
PCT Pub. Date: Feb. 16, 2017

(65) Prior Publication Data

US 2018/0235039 A1 Aug. 16, 2018

(30) Foreign Application Priority Data

Aug. 7, 2015 (EP) ..... 15180219

(51) Int. Cl.
*H05B 33/08* (2006.01)
*H05B 37/02* (2006.01)

(52) U.S. Cl.
CPC ..... *H05B 33/083* (2013.01); *H05B 33/0869* (2013.01); *H05B 33/0872* (2013.01); *H05B 37/0245* (2013.01)

(58) Field of Classification Search
CPC ..... H05B 33/083; H05B 33/0869; H05B 33/0872; H05B 37/0245
USPC ..... 315/151
See application file for complete search history.

(56) References Cited

U.S. PATENT DOCUMENTS

| | | | |
|---|---|---|---|
| 2003/0020595 | A1 | 1/2003 | Wacyk |
| 2008/0265799 | A1 | 10/2008 | Sibert |
| 2012/0068608 | A1 | 3/2012 | Covaro et al. |

FOREIGN PATENT DOCUMENTS

| | | | |
|---|---|---|---|
| JP | 2001167891 | A | 6/2001 |
| WO | 2009060369 | A2 | 5/2009 |

*Primary Examiner* — Daniel D Chang
(74) *Attorney, Agent, or Firm* — Meenakshy Chakravorty

(57) ABSTRACT

A lighting system comprises one or more luminaires for illuminating an environment, each luminaire comprising at least one lamp controllable to emit configurable illumination. A set of configuration data (20') is retrieved from a memory, the set of configuration data for a group of one or more of the lamps in the lighting system, the set of configuration data defining an initial lighting scene for rendering by the group of lamps. It is detected when at least one of the lamps in the lighting system is emitting illumination that would disrupt the initial lighting scene and at least one characteristic of the disruptive illumination is determined. The set of configuration data is modified based on the determined characteristic to account for the disruptive illumination. One or more lamps of the group are controlled, via the control interface, to render a modified lighting scene defined by the modified set.

9 Claims, 4 Drawing Sheets

LIGHTING CONTROL

CROSS-REFERENCE TO PRIOR APPLICATIONS

This application is the U.S. National Phase application under 35 U.S.C. § 371 of International Application No. PCT/EP2016/067803, filed on Jul. 26, 2016, which claims the benefit of European Patent Application No. 15180219.6, filed on Aug. 7, 2015. These applications are hereby incorporated by reference herein.

TECHNICAL FIELD

The present invention relates to controlling a lighting system that comprises one or more luminaires, each comprising at least one lamp, and in particular to controlling a group of lamps to render a lighting scene.

BACKGROUND

In recent years, LED-based lighting solutions have been developed. These are able to provide additional features, above and beyond those of traditional lighting (e.g. incandescent, CFL) technologies. These include, among others, the possibility of tuning the color temperature (e.g. from warm white to cool white) and/or creating a large gamut of colors. For example, the Philips Hue family of products allow for both options: temperature tuning from 2200K to 6500K and around 16 million possible color combinations.

One of the main drivers for this development is allowing customers to go beyond the common use of lighting (either fixed brightness or dimmable brightness) and use these lamps for what is known as mood setting: adapt the lighting in a specific room to match certain decoration, use color combinations to highlight areas and hide others, increase the feeling of warmth or induce higher concentration or energy in users etc.

A lighting system for illuminating an environment typically comprises one or more luminaires, each of which, in turn, comprises one or more lamps such as LED lamps that emit configurable illumination into the environment. Where a luminaire comprises multiple lamps, these may, in some cases, be independently controllable at least to some extent. In order to control the lamps across the luminaire(s), they are connected (e.g. wirelessly or by wired means) to a control mechanism, such as a bridge (e.g. lighting bridge, or home automation server), and thus form a lighting network in which network nodes are e.g. lamps or sets of lamps and/or luminaires or sets of luminaires. The network may have a star topology, whereby the bridge communicates with all nodes directly, a mesh topology, whereby nodes relay control signals to/from the bridge from/to other nodes, or any other suitable network topology e.g. based on a combination of star and mesh-like connections. The network may comprise other types of node, such as dedicated controllers, routers, switches etc.

Mood setting is a key element in modern lighting systems and can be achieved by means of lighting "scenes". Each scene is defined by a respective set of configuration data (scene data set) for a group lamps that belong to that scene, i.e. to which that scene data set relates. The lamp(s) may be of one luminaire or spread across multiple luminaires. The scene data set contains information on which lamps belong to it and defines one or more illumination settings for those lamps. E.g. color setting(s) and/or brightness setting(s), such as a color point and/or a brightness at which each of the lamps is set. Settings in a scene data set may be global (applying to all lamps in the group), individual (applying to only a single lamp in the group), or somewhere in between (applying to a subset of lamps). Users can have multiple scenes configured for each of the possible moods they want to represent (or other ambiance-creating scenarios), and select between them as desired.

From a technological point of view this is enabled not only by the lighting capabilities of the lamps but also by a smart system that can control them according to inputs from users and which communicates internally using a wired (e.g. DMX, DALI) or wireless (e.g. ZigBee) mechanism. Due to this a user can transfer, with minimum effort, the desired configuration or scene recall to all the involved elements. This is referred to in the art as "connected lighting".

A problem in connected lighting is that the devices that belong to a lighting network, and which thus might be part of scenes, can become unreachable. This can occur, for example, if they are out of range, they are not powered, or due to an internal malfunction they cannot communicate or act upon those commands A device that is out of range cannot be communicated with, and as a result it will not change its last state based on inputs from the user. This can for example be caused by:

Some temporary effect that alters the range between critical nodes in a wireless system. For example, increased momentary traffic in the network or some object being placed between devices that does not allow RF signals to propagate correctly;

A device (e.g. a portable lamp) being moved from its last location and it's last location is not suitable for RF communication or is too far away from the closest device;

A node in the network which is key in relying messages to a subgroup of nodes is unreachable, and though there is no specific issue with the subgroup itself, the unreachability of the key node splits the network in two disconnected sections.

In the case of a device that is not powered, this can be because it has been removed/destroyed, the power connection that it requires has been removed (e.g. a wall switch is flipped off for a wireless lamp), or its internal battery source has been depleted (for a battery powered lamp).

In some cases a lamp could seem unreachable even though it is in range and powered; this could be due to an internal malfunction in the device that momentarily or permanently disables the device's capability to communicate and, as such, cannot change its lighting setting. For example, a lamp which has had its internal software updated with an error (i.e. "bug"), could from a wireless point of view still be in range, could be powered by either mains or battery, but could be in an endless loop of software reset from which it cannot get out and as such it ignores all incoming commands from the network Some existing types of bridge include a mechanism to retrieve the availability status of the known nodes, and are thus able to inform the user about the unreachability of the device.

WO 2009/060369 A2 relates to the automatic rendering of a lighting scene with a lighting system, particularly the control of the rendering. A basic idea of the invention is to improve rendering of a lighting scene by automatically compensating interference, such as an alien light source or a dynamic perturbing even of a rendered lighting scene. An embodiment of the invention provides a light control system for automatically rendering a lighting scene with a lighting system, wherein the light control system is adapted for monitoring the rendered lighting scene for the occurrence of interference, and automatically reconfiguring the lighting system such that a monitored occurrence of an interference is compensated. As result, the invention allows to prevent dynamic disturbances or unforeseen events, for example caused by faulty or alien light sources, from distorting the rendering of an intended lighting scene.

US 2012/0068608 A1 relates to a system for auto-commissioning a light fixture which may position the light fixture based on sensor data received from at least one sensor. In order to focus the light fixture on a target location, the system may vary the position of the light fixture and determine a position of the light fixture where the light level received by the photosensor reaches a determined light level. The system may adjust a light characteristic of light emitted by the light fixture so that the color of light received by the photosensor at the target location matches a target light characteristic, such as color or intensity. The system may determine a focus position and a light characteristic for multiple target locations. The system may auto-commission multiple light fixtures.

SUMMARY

According to a first aspect of the present invention, a lighting control apparatus comprises the following components: a control interface, a memory, a scene controller, a detector and a scene modifier. The control interface is configured to connect to a lighting system comprising one or more luminaires for illuminating an environment, each luminaire comprising at least one lamp controllable to emit configurable illumination (e.g. having a configurable brightness and/or configurable color point(s)). The memory is configured to store at least one set of configuration data for a group of one or more of the lamps in the lighting system, the set of configuration data defining an initial lighting scene for rendering by the group of lamps. The scene controller is for controlling the group of lamps, via the control interface, to render lighting scenes. The detector is configured to detect when at least one of the lamps in the lighting system is emitting illumination that would disrupt the initial lighting scene, and determine at least one characteristic of the disruptive illumination. The scene modifier is configured to modify the set of configuration data based on the determined characteristic to account for the disruptive illumination. The scene controller is configured to control one or more lamps of the group, via the control interface, to render a modified lighting scene defined by the modified set. Controlling the group comprises adjusting the illumination of a lamp other than the at least one lamp.

Advantageously, the scene modifier is able to modify the initial scene so that the group (or at least whichever lamp(s) in the group that it is still able to control—see below) provides an overall illumination of the environment when rendering the modified scene that at least approximately matches an intended overall illumination i.e. an overall illumination of the environment that would have been provided had it been possible for the (whole) group to render the (unmodified) initial scene without the disruptive illumination, as intended.

Herein, matching means perceptual matching, from the perspective of a user(s) in the environment so that the perceived overall illumination change due the disruption is minimized, or at least reduced relative to the overall change that would be perceived without the modification. For example, the change may be such that the atmosphere created by the modified scene is as close to the original as possible. E.g. it might be that one vital light is unreachable, which is important to create the overall atmosphere for a specific scene—in this case, the other lamps are adjusted to try and match the original atmosphere as closely as possible. The aim is to provide a user experience as close as possible to the intended user experience of the original scene.

In some embodiments, the group is composed of more than one of the lamps in the lighting system. In this case, the at least one lamp may be part of the group to which the configuration data relates i.e. belonging to the initial scene. The at least one lamp may at some point become uncontrollable by the scene controller e.g. it may become temporarily not possible to communicate with the lamp, or a setting which overrides the scene controller may be applied either manually or automatically. In this case, the scene controller may control one or more of the remaining lamp(s) in the group to provide an overall illumination of the environment that at least approximately matches the intended overall illumination that the whole group would have provided were it controllable in its entirety.

Note "uncontrollable illumination" means illumination that the scene controller, i.e. the component that control lamps based on the stored set of configuration data specifically is not able to control. In embodiments, the uncontrollable illumination may still be controllable by some other means, and in some cases still controllable by some other component of the lighting control apparatus itself such as an internal override mechanism, which may be manual or automatic.

A software implementation is described below, in which the internal override mechanism and the scene controller are implemented by software code executed on a processor of the lighting control apparatus. In this example, the illumination of the at least one luminaire may be uncontrollable by the part of the software implementing the scene controller because it is being overridden by some other part of that software that is implementing the override mechanism.

In other embodiments, the at least one lamp is not part of the group to which the set of configuration data relates e.g. it may be part of some other group controlled based on a different set of configuration data defining a different scene in the same environment that would interfere with the scene in question. As an example, the group may be a group of lamps centered around a table in the environment to for which one scene is selected by a user, and the at least one luminaire may be part of a different group of lights of a home entertainment system, for which a different scene has been selected independently e.g. to create lighting effects which track TV-related content.

The set of configuration data may define one or more illumination characteristics, such as color characteristic(s) and/or brightness characteristic(s) of the lamps(s) in the group. For example an illumination parameter in the set may define an illumination characteristic for a single lamp in the group or more generally a subset of lamps in the group i.e. so that a change in the parameter only changes the illumination of that luminaire(s), or for all of the lamps in the group i.e. so that a change in the parameter changes the illumination of all of the lamps in the group. The lamps in the group may be of a single luminaire, or they may be split between multiple luminaires.

In embodiments where the group is a group of more than one of the lamps in the lighting system, the at least one lamp being part of the group, the detector may be configured to perform said detection by detecting when the at least one luminaire is emitting illumination that is uncontrollable by the scene controller, and the scene controller may be configured to control one or more of the remaining lamp(s) in the group to render the modified lighting scene.

For example, the detector may be configured to perform said detection by detecting via the control interface that the at least one luminaire has become unreachable, and to perform said determination by accessing in the memory a last-known illumination setting of the at least one luminaire.

As another example, the detector may be configured to perform said detection by receiving from an override mechanism an indication of an illumination setting applied to the at least one luminaire to override the scene controller, said determination being based on the received indication.

The lighting control apparatus may include the override mechanism. For example, the lighting control apparatus may comprise a user interface, and the override mechanism may be a manual override mechanism useable via the user interface. Alternatively, the override mechanism may be external to the lighting control apparatus and the indication may be received via the control interface.

In embodiments in which the at least one lamp is not part of the group, the memory may be configured to hold another set of configuration data for the at least one lamp, the other set of configuration data defining another lighting scene for rendering by the at least one lamp; the scene controller may be configured to control the at least one lamp to render the other lighting scene, and thereby cause the at least one lamp to emit the disruptive illumination.

The apparatus may comprise a scene creator configured to allow a user to create, via a user interface, the set of configuration data in the memory.

The determined characteristic may comprise a brightness and/or a color characteristic of the uncontrollable illumination, and the set may be modified to change a brightness and/or a color characteristic of the illumination of at least one other lamp that is in the group. For example, the color characteristics may comprise a color tone and/or a color temperature of the illuminations respectively.

The determined illumination characteristic may comprises both a color characteristic and a brightness of the uncontrollable illumination, and the set may be modified to change a color characteristic of the illumination of at least a first other lamp in the group and a brightness of the illumination of the first and/or at least a second other lamp in the group.

The set of configuration data may define a time-varying effect to be rendered by at least the other lamp, and said modification may comprise modifying the time-varying effect to account for the disruptive illumination.

The set of configuration data may be modified by generating a separate modified version of the set in the memory, whereby the set which defines the initial scene is retained in the memory in an unmodified form.

The detector may be configured to detect when the at least one luminaire ceases to emit the disruptive illumination, and the scene controller may be configured, in response, to access the unmodified set of configuration data and control the group to render the initial lighting scene.

The scene modifier may be configured to determine a type of the set, and said modification may be based on the determined type.

A second aspect of the present invention is directed to a method of controlling a lighting system comprising one or more luminaires for illuminating an environment, each luminaire comprising at least one lamp controllable to emit configurable illumination, the method comprising: retrieving a set of configuration data (20') from a memory, the set of configuration data for a group of one or more of the lamps in the lighting system, the set of configuration data defining an initial lighting scene for rendering by the group of lamps; detecting when at least one of the lamps in the lighting system is emitting illumination that would disrupt the initial lighting scene; determining at least one characteristic of the disruptive illumination; and modifying the set of configuration data based on the determined characteristic to account for the disruptive illumination; and controlling one or more lamps of the group, via the control interface, to render a modified lighting scene defined by the modified set, wherein controlling the group comprises adjusting the illumination of a lamp other than the at least one lamp.

In embodiments, the method may implement any of the apparatus functionality disclosed herein A this aspect of the present invention is directed to a computer program product comprising executable code stored on a computer-readable storage medium and configured when executed to implement any of the method or apparatus functionality disclosed herein.

BRIEF DESCRIPTION OF FIGURES

To aid understanding of the present invention and to show how embodiments may be put into effect, reference is made by way of example to the accompanying drawings in which.

DETAILED DESCRIPTION OF EMBODIMENTS

Figure 1:
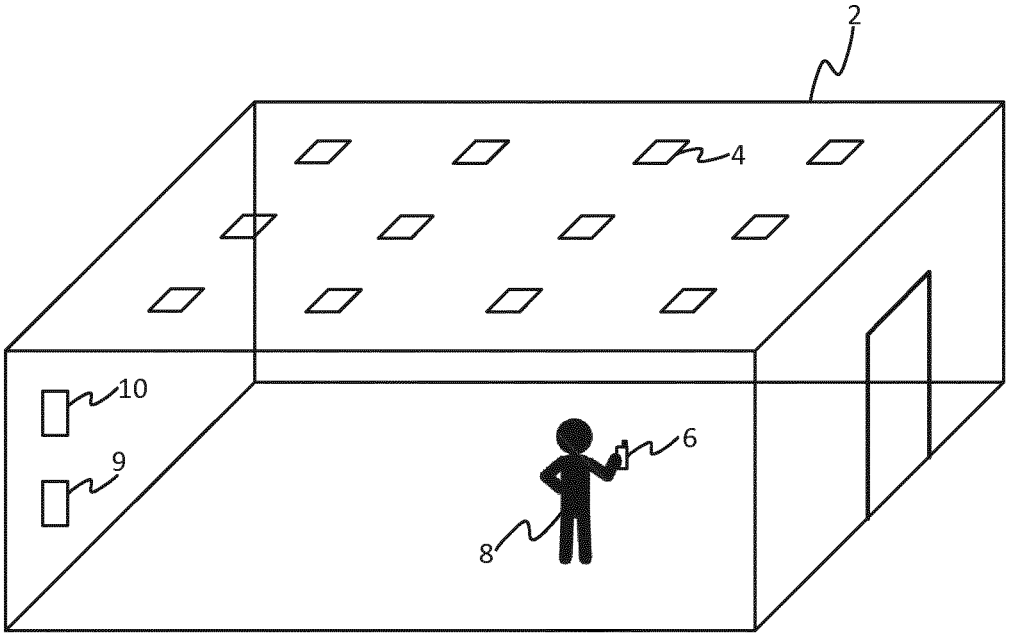
FIG. 1 is a schematic illustration of a lighting system.

Some embodiments of the present invention provide scene and ambiance adaptation based on one or more missing, or otherwise uncontrollable, network elements (e.g. lamps, luminaires, control or relay components etc.) in a lighting network of a controlled lighting system, which cause one or more lamps to become "stuck" on whichever light output mode they were configured to when they became unavailable.

Other embodiments provide such adaptation when network elements are not uncontrollable as such, but are nonetheless disruptive e.g. because a user(s) has imposed conflicting illumination requirements on the system i.e. which are to some extent incompatible.

Different mechanisms are provided, by which the system can, based on its knowledge of node reachability, correct and update known illumination configurations to offer to the user an experience (in terms of ambiance creation or other factors) resembling as closely as possible the expected one. This ensures that, even if node(s) are unreachable, or otherwise disruptive, the overall user experience is not affected or at least that negative effects are mitigated as much as possible.

Below is described a lighting control method which comprises detecting that network elements belonging to or affecting a group of lamps are malfunctioning or are not present, and adapting or adjusting settings, which are commonly recalled for this group by the user, as a result of this detection. This provides an optimized user experience in terms of how scenes and overall ambiance is achieved, increasing robustness of the system and limiting the (perceived) impact it has.

A wireless lighting system is provided, in which multiple devices or nodes are part of a network, and in which it is possible to assign and recall specific configurations for each or all of them, with the purpose of establishing a known state which the user can select from a list. The system includes a mechanism by which a reachability state (reachable or unreachable) of all nodes belonging to the network can be established.

A set of configuration options for the devices in the network is provided, whereby different parameters can be set individually for these devices and can be modified and read. One or more control mechanisms as also provided for users to edit, save, and select the different configuration options.

A set of algorithms is provided that can—based on the list of known devices, their possible and used parameters, and the reachability state of these devices—update, improve, or correct these parameters such that the integral effect provided resembles a previously determined set of configuration options.

Embodiments are described in the context of a system architecture, in which communication is conducted using the ZigBee wireless protocol via a main control device known as the bridge. For example, the Philips Hue family of products are based on this architecture. This is exemplary, and the subject matter can be applied to other types of architecture (see below). For example, communication within the lighting system may be based on Bluetooth, Wi-Fi, etc.

FIG. 1 illustrates an example lighting system in relation to which the disclosed techniques may be implemented. The system comprises one or more luminaires 4 installed in an environment 2, arranged to emit light in order to illuminate that environment 2. The environment 2 may be an indoor space such as one or more rooms and/or corridors, or an outdoor space such as a park or garden, or a partially covered space such as a stadium or gazebo, or any other space such as an interior of a vehicle, or any combination of these. Each of the luminaires 4 comprises at least one respective lamp such as an LED-based lamp, gas-discharge lamp or filament bulb, plus any associated housing or support. Each of the luminaires 4 may take any suitable form such as a ceiling or wall mounted luminaire, a free standing luminaire, a wall washer, or a less conventional form such as a luminaire built into a surface or an item of furniture, or any other type of illumination device for emitting illumination into the environment 2 so as to illuminate the environment 2.

To control the lighting system, a user device 6 is operated by a user 8. For example the user device 6 may take the form of a mobile user device such as a smartphone, tablet or laptop, or a dedicated remote control unit for the lighting system; or alternatively the user device 6 could be a non-mobile terminal such as a desktop computer or a wall-panel. The user device 6 can be mains powered, battery powered, or use energy-harvesting techniques to supply its energy. The user device 6 is configured to be able to control the illumination emitted by one or more of the luminaires 4 in the lighting system. This includes at least being able to control the color of the illumination, and optionally one or more other properties such as overall intensity or a dynamic (time-varying) effect in the illumination. The user device 6 does not need to be present in the environment 2 (though that possibility is not excluded).

Figure 2:
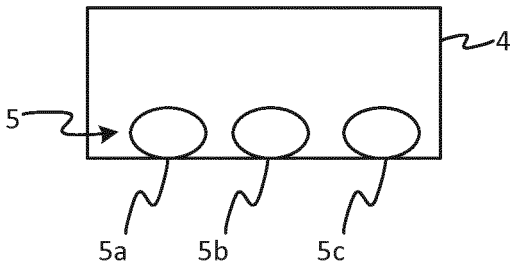
FIG. 2 is a schematic block diagram of a luminaire.

FIG. 2 shows one of the luminaire(s) 4. The luminaire 4 comprises one or more controllable lamps 5, each configured to emit illumination. The illumination emitted by the luminaire 4 is the aggregate illumination emitted by its lamp(s). Three lamps 5*a*, 5*b*, 5*c* are shown in FIG. 2, but this is purely exemplary. A controllable lamp 5 is controllable to change at least one illumination characteristic (e.g. color characteristic, brightness characteristic) of its emitted illumination. Where a given luminaire 4 comprises multiple controllable lamps 5, their illumination characteristic(s) may be fully independently controllable i.e. in this example, the illumination characteristic of lamp 5*a* is controllable independently of lamps 5*b*, 5*c*; lamp 5*b* independently of lamps 5*a*, 5*c*; and lamp 5*c* independently of lamps 5*a*, 5*b*. Alternatively, their illumination characteristic(s) may not be controllable independently of each other, so that the illumination characteristic(s) can only be changed for all of the lamps 5 together, or they may be partial independent e.g. it may be possible to control lamp 5*a* independently of lamps 5*b*, 5*c* but only to control lamps 5*b*, 5*c* together. Different illumination characteristics may have different levels of independence, e.g. one type of characteristic may be fully or partially independently controllable and another may not be independently controllable or may be partially independent but in a different way.

To enable the user device 6 to control the illumination, there are a number of options, e.g. as follows.

Figure 3B:
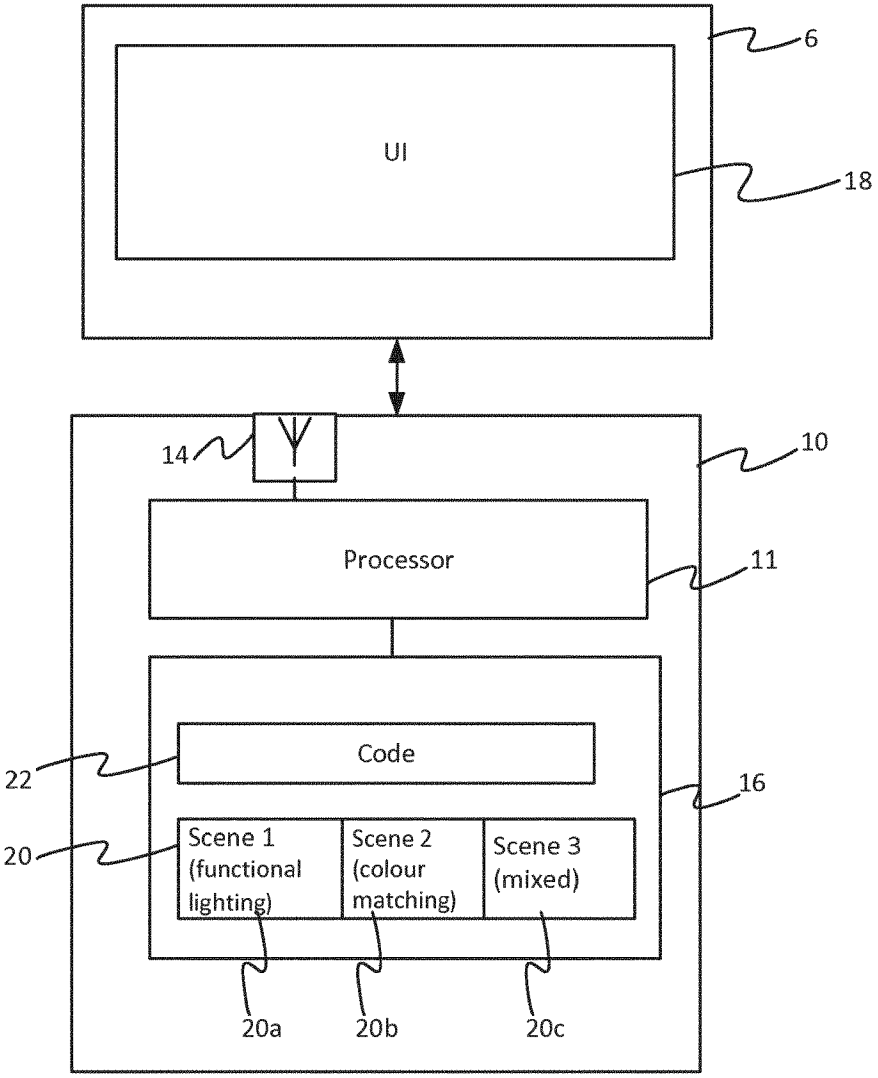
FIG. 3B is a schematic block diagram of a second exemplary lighting control apparatus in the form of a bridge.
Figure 3A:
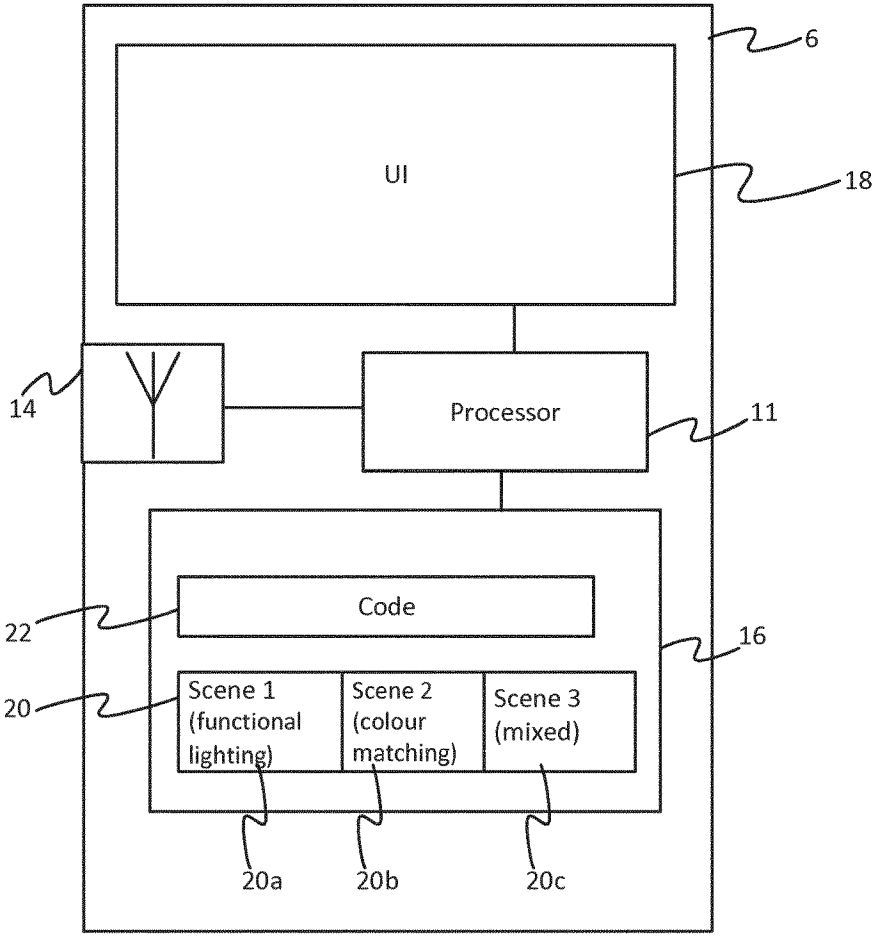
FIG. 3A is a schematic block diagram of a first exemplary lighting control apparatus in the form of a user device.

FIG. 3A illustrates the user device 6 in more detail in one example. The user device 6 comprises processor 11 (comprising one or more processing units), a memory 16 (comprising one or more storage devices) connected to the processor 11, and a control interface in the form of a communications interface 14 for communicating with the lighting system. The memory 16 holds lighting control code 22 for execution on the processor 11. The processor 11 is operatively coupled to the communications interface in order to perform, via said interface 14, the described control of the illumination emitted by one or more of the system's one or more luminaires 4. The communications interface 14 may comprise a wireless transmitter or transceiver such as a Wi-Fi, ZigBee or Bluetooth interface; or a wired connection such as an Ethernet, DMX or DALI interface. The memory 16 can be formed of a plurality of different types of memory e.g. the lighting control code 22 can be stored in a different type of memory (which may in some cases be part of the processor 11) from the scene variables.

The user device 6 also comprises a user interface (UI) 18 operatively coupled to the control system 12. In some systems, the user interface comprises a display in the form of a screen and means for receiving inputs from the user. For example, the user interface 18 may comprise a touch screen, or a point-and-click user interface comprising a mouse, track pad or tracker ball or the like. Alternatively or in addition, the user interface may comprise a dedicated control panel for controlling the lighting system. For example, the user device may be in the form of a dedicated control unit (wired or wireless) which can be operated by the user 2, e.g. using one or more buttons, sliders switches, and/or dials of the dedicated control panel. Examples of dedicated control units include remote controls, wall mounted switches etc.

In the example of FIG. 3A, the scene processing is performed by the user device 6.

FIG. 3B illustrates a preferred alternative, in which at least some of the scene processing is performed by a central control module 10 (sometimes known as a bridge). In this case, the processor 11, memory 16 and control interface 14 form part of the bridge 10. In this example, the user interface 18 of the user device 6 is used to control the scene processing by the bridge 10; the user device 6 may for example be a remote control, tablet, phone, etc. in this context.

Figure 4:
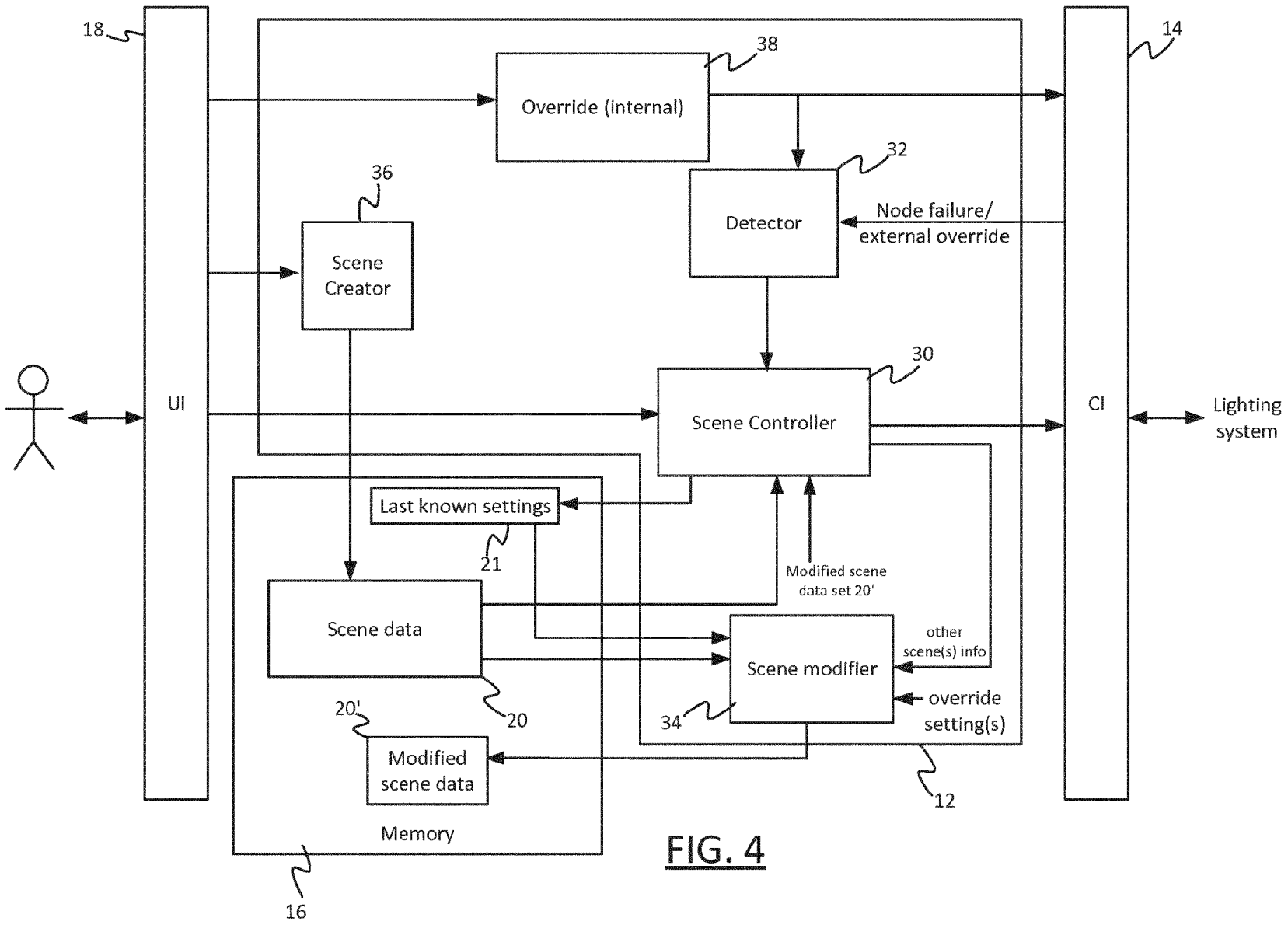
FIG. 4 shows software modules of a lighting control apparatus.

FIG. 4 is a function block diagram which shows a control system 12, implemented by running the code 22 on the processor 11 of the user device 6 or bridge 10 as applicable. More generally, the control system can be distributed across multiple devices within the system 10, for example part of it may be implemented at the user device 6 and another part at the bridge 10.

The control system 12 comprises the following functional modules: a scene controller 30, a detector 32, a scene modifier 34, a scene creator 36, and an (internal) override mechanism 38. The functional modules are software modules i.e. each represents functionality implemented by executing a respective portion of the code 22 on the processor 11.

The control system 12, and in particular each of the scene controller 30 and the override mechanism 38, is configured to control the illumination characteristics, such as color and/or brightness of lamps 5, based on inputs received via the UI, for example to render a selected color or provide a selected brightness of illumination. This control is effected via the control interface 14.

In controlling the illumination emitted by the lighting system, the control system 12, when implemented on the user device 6, may use the interface 14 to communicate a lighting control request to each individual one of the one or more luminaires 4 being controlled, to control them individually. Alternatively the control system 12, when implemented on the user device 6, may perform the control by using the interface 14 to communicate a lighting control request to the bridge 10, which processes the lighting control request to control the relevant one or more luminaires 4 accordingly. When the control system 12 is implemented at the bridge 10, the operation of the control system 12 is controlled by sending request from the user device 6.

The central control module 10 may be implemented in a dedicated control unit installed in the environment 2, e.g. a wall-mounted control unit; or may be implemented on a server comprising one or more server units at one or more sites, either in the environment (e.g. same building) and/or off-site at a remote location.

Either way, the requests may be acted upon unconditionally, or one or more conditions may be applied by the control module 10 or luminaire(s) 4. E.g. in the case where the control goes via a central control module 10, the central control module 10 may be arranged to verify an identity of the user device 6 or its user 8 before allowing the control; and/or may be arranged to verify that the user device 6 or its user 8 is found within a certain spatial or geographical region before allowing the control (e.g. based on an indoor positioning network or a presence sensing system), such as to verify that the user device 6 or its user 6 is located within the same environment 2 as the lighting 4 being controlled (e.g. the same room or building).

In the case of a wireless interface 14, the communication may be direct with a corresponding receiver or transceiver on each luminaire 4 or the central control module 10, e.g. using ZigBee or Bluetooth as the wireless access technology; or via an intermediate wireless router 9 disposed in the environment 2, e.g. using Wi-Fi as the wireless access technology (though these technologies are not limited to these respective direct or router-based arrangements).

The scene creator 36 is configured to allow the user to create a lighting scene for a lamp group via the UI 18, which is stored in the memory 16, for later use, as a set of configuration data 20 ("scene data set"). The lamp group is a group of at least one, though preferably multiple, lamps 5 that are controllable (or at least intended to be controllable) by the scene controller 30. The lamps in the lamp group may be part of the same luminaire 4 or spread across multiple luminaires 4. The scene data set 20 comprises one or more illumination settings (parameters), and thereby configures at least one illumination characteristic of the illumination of each lamp in the lamp group.

For each lamp in the lamp group to which the scene data set 20 relates, at least one illumination parameter in that set that applies to that lamp. An illumination parameter may be a group-wide parameter applying to every lamp in the group—e.g. in the simplest case a scene data set may consist of a single parameter, e.g. color or brightness, that applies to every lamp in the group. However, preferably there is at least some degree of independence of the parameters so that at least some level of individualized control is possible. For example, a scene may comprise at least one individual parameter for every lamp in the group (i.e. at least one independent parameter per lamp), so that at least one illumination characteristic of every lamp can be controlled independently of all the other lamp(s) in the group. In some cases, three independent parameters may be provided for every lamp in the group (i.e. three independent parameters per lamp), so that the brightness and color of every lamp can be controlled entirely independently of all other lamps in the group. For example, the scene may comprise a color 3-vector in a color space (e.g. CIE color space) for every lamp in the group, which defines a color (i.e. chrominance) and luminosity for that lamp, and which the user has configured via the UI 18. As one example, the scene creator 36 may be configured to display an image selected by the user, and to allow the user to select colors from within the image that are used to set the values of the illumination parameters in the set. As another example, the values of the illumination parameters may be set automatically based on the user-selected image, for example with the aim of the lamp group rendering a lighting scene that reflects the essence of the image. The two approaches can be combined, so that the values are set in part automatically based on the user-selected image and in part based on the user selecting specific parts of the image.

Alternatively or in addition, the scene creator 36 may be configured to present a list of configuration options to the user. These can be, in the case of lamps, values for brightness, colors, and temporal variations of these i.e. to introduce dynamic, time varying visual effects. A scene data set 20 for a lamp group is created in the memory 16 based on the user selected options.

By way of example, FIG. 3 shows the memory 16 holding three such user-created scene data sets 20*a*, 20*b*, 20*c*. These may relate to the same lamp group, or to different lamp groups etc.

In some embodiments, the control code 22 may be distributed with preconfigured scene data sets, defining preconfigured scenes that are held in the memory 16 as scene data sets. The user can modify these preconfigured scenes (in some cases) and can also modify their own scenes which they have created themselves via the UI 18. When a scene is modified, the scene creator 36 updates the relevant scene data set 20 in the memory 16 accordingly.

The scene controller 30 is configured to allow the user to recall scenes 20 to his/her liking, depending on the type of ambiance or mood that is of interest to be set, via the UI 18. When a user selects a scene defined by a particular scene data set 20 in the memory 16, in the absence of any disruptive illumination that has been detected in the environment (see below), the scene controller 30 controls all the lamps in the lamp group to which it relates to render the scene based on the scene data set 20, by controlling illumination settings of the lamps 5 in the lamp group to alter one or more illumination characteristics of their illumination.

The scene creator 36 allows the user to manually modify scenes 20 that are held in the memory 16 e.g. to refine or tweak them to their personal preferences.

By contrast, the scene modifier 34 is configured to automatically modify scenes under certain circumstances i.e. without the user explicitly instructing it to do so. As explained in further detail below, the scene modifier 24 modifies a scene data set 20 by generating a modified version of the scene data set 20' that is stored in the memory 16 separately from the original 20. The original scene data 20 is still retained in the memory in its original, unmodified form and remains accessible to the scene controller 30. The scene data 20 is updated by the scene modifier 34 in order to take account of any disruptive illumination in the illuminated environment.

As one example, the source of disruption may be a lamp(s) 5, in the lamp group belonging to the original scene itself as defined by the unmodified scene data 20, that is normally controllable by the scene controller 30 but which has become unreachable via the control interface 14 and is stuck on a particular light output mode.

The scene controller 30 is also configured to store, in the memory 16, the current illumination settings for the lamps 5 in the lamp group. The stored settings are labelled 21 in FIG. 4. The stored settings 21 are updated whenever the settings of a lamp(s) 5 in the lamp group are altered by the scene controller 30, and thus constitute the last known settings of the lamps 5 in the lamp group. The stored settings 21 are accessible to the scene modifier 34 for the purpose of modifying scene data sets 20, so as to account for luminaires that are known (or can be assumed) to have become stuck on their last known setting and are thereby emitting disruptive illumination.

Various exemplary algorithms which can be implemented by the scene modifier 34 and by which scenes can be updated in case some of the nodes associated with it are not reachable will now be described.

In the example below, the algorithms are able to distinguish between and adapt to lamps failing (so that they are incapable of emitting any illumination), in addition to lamps becoming stuck on known settings.

Various techniques can be used to distinguish between a lamp that is off, and a lamp which is stuck on a particular illumination setting. Some examples are given below.

As a first example, a first, functional lighting scene 20*a* (FIG. 3) is created where all the lamps 5 in a lamp group are set in a predetermined color (e.g. white) for homogenous illumination, and at a specific brightness level. A first adaptation algorithm implemented by the control system 12 determines whether one or some of those lamps providing functional lighting are unreachable. If so, the first algorithm will redeploy a new scene setting to the reachable lamps in which their individual brightness levels are increased according to a desired formula, with the goal of providing an overall ambient brightness level comparable with the one from the original scene.

For example, if there are multiple lamps 5 in a luminaire 4 over a large dining table and one of them fail or become stuck on a low brightness, the remaining ones can increase brightness so that flux on the table is as high as intended. Without this first algorithm, there would either be dark spots in the room, or the available brightness would not be sufficient to carry out certain tasks. It will not always be possible for the scene controller to do this e.g. if all lamps in the scene are already set at their maximum brightness, then there is nothing the scene controller can do to compensate for the stuck lamp. Nevertheless, wherever possible, it will attempt to compensate.

As a second example, a second scene, color matching scene 20*b* is created to replicate colors and tonalities of a specific setting, like a photograph or another (e.g. outdoor) environment. The scene 20*b* may be automatically created in response to the user selecting the photograph, or in response to a monitoring of the other environment.

In this type of setting it is generally not as important to match selected colors perfectly well, but rather give the overall impression of those colors being present or being mixed correctly. In case one or more lamps 5 in this scene become unreachable, the overall experience might differ or not resemble the intended source. For example, an image of a blossoming tree used to create a lighting scene might be translated into the lighting colors of unsaturated green and pink. In case the pink cannot be rendered, because its destination lights are unreachable, some green lights could be substituted for pink lights.

A second adaptation algorithm slightly modifies the tonality of all other lamps 5 in the lamp group such that, in total, they give an impression of covering the whole of a specified color spectrum. For example, in a scene replicating autumn colors, there is a large content of red and yellow. Should a lamp fail, the illumination of all others in the group may be moved closer in the spectrum to orange to give the same or at least a similar overall impression. For example, one possibility would be to stress the colors by moving to a more "contrasting" color point and possibly higher brightness such that they counteract the effect of the stuck lamp. E.g. if colors in the range of greens and blues are desired, and a lamp got stuck in red, then the remaining lamps could be controlled to move farther away from the red and more into the blue, possibly with more saturation and brightness than that of the red lamp depending on the circumstances.

As a third example, the first and second algorithms can be used in combination, where it is desired to recreate a certain palette of colors, some of which are more brightness-sensitive than others. The combined algorithms will compensate not only for the color mismatch, but also brightness in the affected lamps so that overall ambient light is maintained. Combining the first and second algorithms is suitable, for example, for a third scene 20*c* which combines functional and color matching aspects. In this case the system could also decide to substitute a light used for atmospheric lighting with functional lighting in case a functional light is not reachable, in order to provide the desired light level.

It is unknown by the scene controller 30 whether the unreachable lamps will at some later point in time become reachable again or they are in a state from which they will never recover. As such, the scene controller 30 is configured so as not to overrule in a definitive way the original scene 20 that was configured by the user. In these examples, the original scene 20 as retained in the memory 16 is always used as a starting point for the relevant adaptation algorithm(s) such that if all involved lamps 5 become available, this is the scene that is triggered in response.

The adapted scene 20' that is created as a result of the relevant algorithm(s) is not final, in the sense that both the number and/or type of unreachable lamps 5 may differ over time. Therefore, every time that the user recalls this scene, the scene controller 30 evaluates whether an adaptation is needed based on unreachability and if so the algorithm(s) are be executed on the original scene 20 (not the modified scene 20').

The adaptation can take place when selecting a scene or when the system detects that the reachability state of a lamp involved in the current scene changes.

In short, the adapted scenes 20' are regarded by the scene controller 30 as a temporary solution from which it is desired to recover if the necessary conditions, i.e. the relevant lamp(s) becoming available again, are met.

Figure 5:
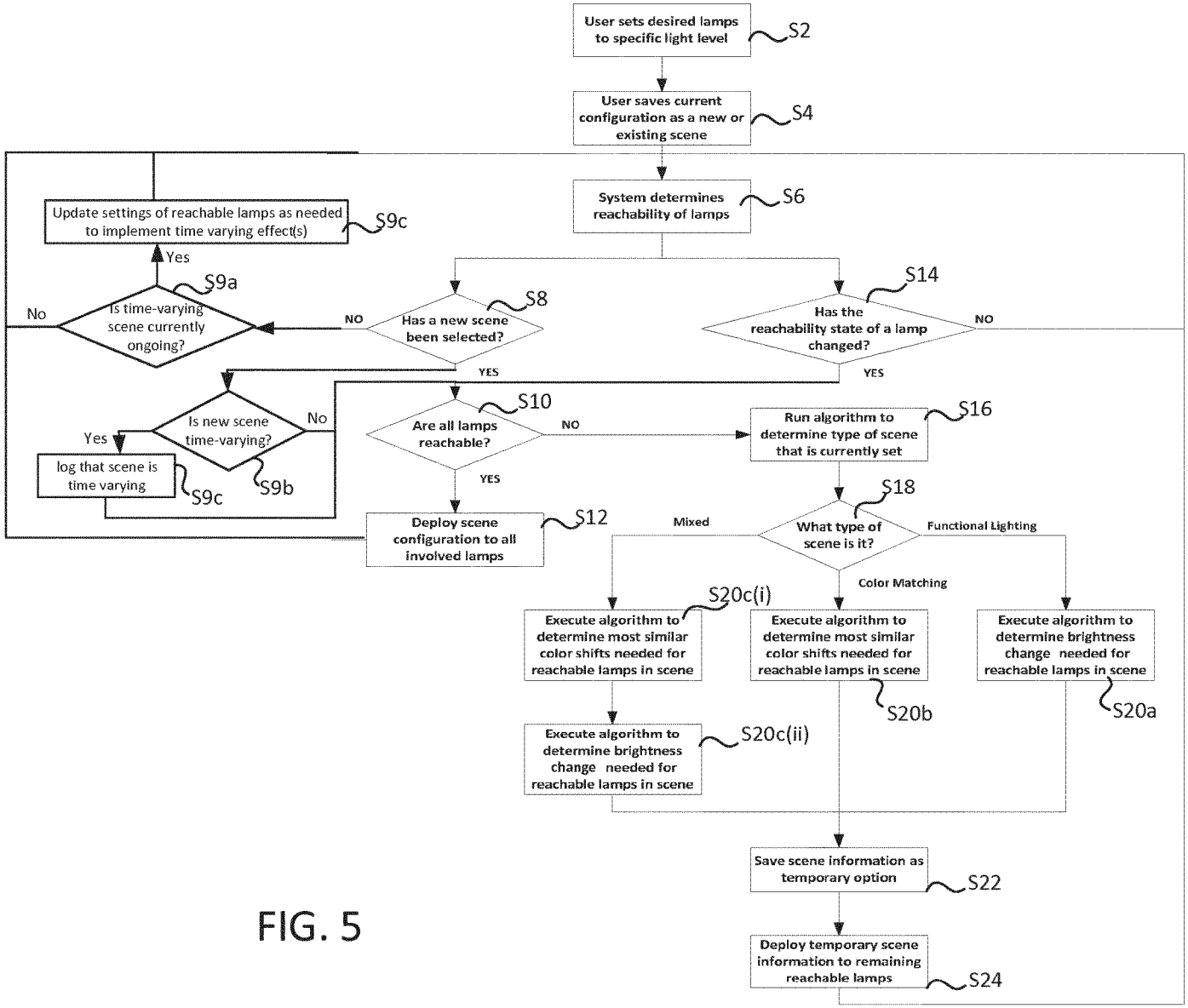
FIG. 5 is a flow chart for a lighting control algorithm.

A lighting control method incorporating these various algorithms will now be described with reference to FIG. 5, which shows a flow chart for the method.

At step S2, the user sets, via the UI 18, a lamp group of one or more desired lamps 5 to a specific illumination configuration, by setting one or more illumination settings (e.g. color and/or brightness) of each to a desired level, and thereby creates a scene for rendering by those lamp(s). The scene controller 30 controls the lamps 5 to render the scene via the control interface 14.

At step S4, the user saves the scene using the UI 18. The user may select to save the settings as a new scene, in which case a new scene data set 20 defining the scene is created by the scene controller 30 in the memory 16, or as an existing scene, in which case an existing scene data set 20 is modified in the memory 16 by the scene controller 30 (note this is a manual modification, separate from any automatic modification by the scene modifier 34).

At step S6, the detector 32 determines the reachability state of the lamps 5 in the lamp group. This is determined via the control interface 14, for example by querying the lamps 5 and determining whether a response is received before a timeout, or by monitoring whether or not an expected signal has been received by the lamps 5 (e.g. the lamps 5 may be configured to instigate heartbeat signals to the control system 12 at regular intervals).

The method distinguishes between static and dynamic (time-varying) lighting scenes i.e. scenes defining only static lighting effect(s), and scenes defining at least one time-varying lighting effect. For a static scene, illumination settings only need to be applied to the relevant lamps 5 when the scene is first selected, or when the reachability state of one of those lamps changes. By contrast, for a time-varying scene, new settings need to be applied to the lamps 5 repeatedly, in order to implement the dynamic effect, for as long as the time-varying scene remains selected even if there is no change in their reachability.

Where the currently selected scene is a static scene (s9*a*, "No" branch), for as long as the current scene (S8) is selected and all the lamps 5 in the group are reachable (S10), step S6 is repeated so as to monitor the current reachability state of the lamps 5 in the lamp group (see below for dynamic scenes).

If, whilst the current scene is selected, a change in the reachability state of one or more lamps 5 in the lamp group changes (S14), the method proceeds to step S10. If it is the case that not all of the lamps 5 in the group are reachable, the method proceeds to step S16 at which an appropriate scene modification algorithm(s) is instigated to account for this.

Also, in response to the user selecting a new, pre-stored scene, by selecting a new previously-created scene data set in the memory 16, it is determined whether or not the new scene is time-varying (S9*b*). If it is, then that is logged in the memory 16. Either way, the method then proceeds to step S10, at which the detector 32 determines whether or not all the lamps 5 in the lamp group to which the new scene data set relates (which may be the same or different from the lamp group of the previously selected scene) are reachable. If not all are reachable, the method proceeds to step S16 in the same manner.

Thus step S10 may, depending on the circumstances, be triggered in response to a lamp 5 becoming unreachable or in response to the user instigating a change of scene (if an already-unreachable lamp 5 happens to belong to the newly-selected scene). Note that step S10 always results in new settings being applied to the lamps 5 in the lamp group—either at step S12 or step S24 (see below). For static scenes, this is sufficient to ensure that illumination settings are always updated at the appropriate time. For a dynamic scene, additional steps are taken to reapply different settings repeatedly whilst the scene remains selected to implement the time varying effect(s) (see below).

At step S18, the scene modifier 34 determines a type of the current scene, and selects a scene modification algorithm to be applied based on the determined type. The type may for example be stored in association with the scene data set (e.g. having been set by a user), or it may be determined automatically by analyzing the scene data set 20.

For example, if the scene is of a purely functional type, such as that defined by the functional scene data set 20*a*, the first algorithm is applied to the underlying scene data set 20*a* (S20*a*). E.g. is a lamp(s) 5 in the group is stuck on a particular brightness, the brightness of the remaining lamp(s) in the group may be increased or decreased as appropriate to account for this, so that the same overall brightness is provided by the group as a whole (including the uncontrollable lamp(s)).

If the scene is of a color matching type, such as that defined by the color matching scene data set 20*b*, the second algorithms is applied to the underlying scene data set 20*b* (S20*b*). E.g. the colors of the remaining lamp(s) may be adjusted so as to match as closely so that the whole group (including the uncontrollable lamp(s)) as possible the intended overall tonality.

If the scene is of a mixed type, such as that defined by the mixed scene data set 20*c*, both the first and second algorithms may be applied, for example to first determine appropriate color shifts (S20*c*(i)) and then a change in brightness (S20*c*(ii)). Note this is exemplary: steps S20*c*(i) and S20*c*(ii) may be applied in either order, or in parallel.

As step S22, the modified version of the scene 20' is saved in the memory 16 as a temporary option, without overrating any of the original scene data set 20. The modified version of the scene 20' defines a modified scene, which the remaining lamps(s) 5 in the lamp group are controlled to render by the scene controller 30 at step S24.

Should a change of reachability state result in all lamps becoming reachable, or if all lamps in the lamp group to which a newly-scene relates are reachable at the time it is selected, the method proceeds from step S10 to step S12 instead. At step S12, all the lamps 5 in the lamp group are controlled to render the unmodified scene defined by the original scene data set 20 (in favor of the temporary option, where applicable). Thereafter, the method proceeds as above from step S6.

For a dynamic scene, as long as that scene remains selected, the illumination settings of the reachable lamps 5 are still repeatedly updated over time (S9*c*) to implement the dynamic effect(s) it defines, even whilst the reachability states of the relevant lamps 5 remain unchanged. If all the relevant lamps 5 are reachable, there settings are defined by the original scene 20. If at least one is not reachable, these settings are defined by the appropriate modified scene 20'.

In some embodiments, if at least one of the lamps 5 is unreachable, the method repeatedly executes one of the algorithms of steps S20, each time a change defined by the dynamic scene occurs, to determine new illumination settings to be applied at that time (e.g. by routing the "yes" branch of step S9*a* to step S10 in the flow chart).

In other embodiments, the scene modification algorithm is only executed when the dynamic scene is first selected or a change in reachability state occurs, in order to determine all of the illumination settings of the modified scene i.e. that cover all possible times for as long as that scene remains loaded and the lamp reachability state does not change. In this case, at step S9*a*, whichever subset of the modified settings applies to a particular time is used at that time.

Note that a lamp becoming unreachable and stuck on a known illumination setting is just one example of disruptive illumination that the present mechanisms can account for.

As another example, disruptive illumination can arise when a user sets a scene, then the user controls a lamp in the scene to change its output using a manual override mechanism. As an example, all lamps may be set to a low dim level in rendering a desired scene. The user may then switch on a reading function on one of the lamps 5 (giving little or no thought to the effect this will have on the scene as a whole), such that there is suddenly more light in the scene than there should be.

For example, FIG. 4 shows a manual override mechanism 38 provided by the software 22 of the same user device 6 which is controllable via the user interface 18 to override the scene controller 30. Alternatively or in addition, an external override mechanism may be provided—such as a mechanism embedded in a lamp 5 or luminaire 4—the actions of which are detectable by the detector 32 via the control interface 12. Either way, the detector 32 can detect when an override setting(s) has been applied. The scene modifier 34 receives the override setting(s), i.e. it knows what brightness, color etc. has been applied to override the scene controller 30, so that it can modify the scene data set 20 accordingly to account for it/them.

Alternatively or in addition, an automatic override mechanism (internal or external) may have the same effect and may be accommodated in the same way. For example, an automatic override mechanism may override the scene controller 30 to stop a lamp from overheating, based on an external trigger such as a movement detection etc.

Whatever the cause of the manual or automatic override, the scene modifier 34 modifies the scene automatically without any (further) user input to account for the override setting(s).

In the case of a manual override, the scene modifier 34 is in effect recognizing that the user has (or different users have) provided conflicting instructions to the lighting system: on the one hand they have selected a scene, and thereby indicated that they want a particular perceptual effect across the whole lamp group; on the other hand, they have indicated an individual, conflicting requirement for at least one of these lamps. The scene modifier 34 accounts for this by modifying the scene so that the overall desired effect of the scene is retains as closely as possible, whilst still accommodating the user's individual requirements.

More generally, scenes can be adapted by the scene modifier 34 as a result of knowing that one or more of the lamps in the lighting system (which may or may not be used in the scene in question) will be changed as a result of a new, different, and/or 3rd party-related event.

As an example, this could be done to prevent such an event from dominating the entire scene (i.e. from changing the overall ambiance). For example, if a group of lamps is being used for a periodic, known dynamic effect (the effect need not be known, but at least that the system should expect periodic changes to that light setting), the remaining lamps could strengthen their features so that at least a part of the scene remains to the user unchanged. For example, in a living room where there is a dining table with luminaires on top, and a couch and TV with lamps around them. If someone is working on the table and sets a "concentrating" scene but another person wants to play video games with the TV/couch lamps linked to the game effects, both scenes should agree on how to limit the cross-scene interference by, e.g., increasing the brightness of the table lamps, decreasing the brightness of the TV lamps, or making the effects coming from the TV a little bit whiter, so that the contrast is not so big etc.

In other words, two lamp groups in the same environment may be separately controlled to render separate scenes. Where these selections can be made at the same user device 6, separate and independently selectable scene data sets 20 are held in the memory 16.

From the perspective of one of the scenes, the illumination from the other is a disruption (and possible vice versa) that can be accounted for by the scene modifier 34. The scenes are selected separately, by the same user or a different user using the same user device 6 or different user device. In the case that two scenes are selected using the same user device 6, the scene modifier 34 is in effect accounting for the fact that it has received two sets of conflicting instructions from the user(s), and is resolving this conflict by matching as closely as possible the desired perceptual effect for each selected scene, even if this involves deviating slightly from the precise scenes that have been selected.

These various mechanisms are particularly suitable for implementation by the Philips Hue family of products, as these have scene, mood setting and ambiance creation functionality. However, the subject matter is not limited to this, and is also applicable to other lighting systems in which modifications to color, brightness, and/or CCT (correlated color temperature) etc., or combinations thereof, are desirable to maintain a constant, or perceptually similar, user experience. For example, the mechanisms have useful applications to, for example, to professional lighting systems such as office or street lights.

In the case of dynamic (i.e. time-varying) scenes, a time-varying effect of the scene may be modified to account for disruptive illumination. For example, an initial scene may define a configuration such that all lamps in the scene cycle through the colors of the rainbow.

As a specific example, the cycling through the colors of the rainbow may be an offset cycling, whereby, at a first time, a first lamp is red, a second lamp is orange, a third lamp is yellow etc.; at a second time, the first lamp changes to orange, the second to yellow, the third to green etc.; at third time, the first lamp changes to yellow, the second to green, the third to blue etc. At any one time, each color of the rainbow is rendered by one (and only one) of the lamps. Should one of the lamps become stuck on, say, orange, the effect can be modified so that all the other lamps skip orange i.e. cycle between red, yellow, green, blue, indigo, and violet. Thus, the effect still remains dynamic and perceptually close to the original, but maintains the property of each color of the rainbow being rendered by one (and only one) lamp at a time.

In accounting for disruptive illumination, the scene modifier 34 determines at least one illumination characteristic (e.g. color characteristic(s) and/or brightness characteristic(s)) of the disruptive illumination based on:

the last known settings 21 (for a disruptive lamp that is stuck);

a received override setting(s) (for a disruptive lamp to which an override setting(s) has been applied;

information about a different scene being rendered in the same environment received from the scene controller 30 or another such scene controller (for a disruptive lamp belonging to the different scene).

The scene modifier 34 accounts for the disruptive illumination, whatever the source may be, based on the determined characteristic. For example, where the determined characteristic is a brightness (resp. color characteristic), it may adjust a brightness (resp. color characteristic) of one or more controllable lamps 5 in the lamp group belonging to the scene in question e.g. to achieve the same overall brightness (resp. the same average color, spread of colors (e.g. variance) etc.).

In the above-described embodiments the control system 12 is implemented in software code 22 stored in the memory 16 and configured to perform operations in accordance with the techniques disclosed herein. Alternatively the control system 12 may be implemented in dedicated hardware circuitry, or configurable or reconfigurable circuitry such as a PGA, FPGA, microcontroller or microprocessor, or any combination of software and hardware—either at a single device, or distributed across multiple devices.

As indicated above, various techniques can be used to distinguish between a lamp that is off and a lamp which is stuck on a known illumination setting.

As a first example, timestamps can be used: each lamp 5 (or other device in the network) has a counter that is increased every fixed amount of time while it is powered. Each time a message is transmitted the lamp 5 adds to that message the latest value of that counter (i.e. timestamp) and sends it. A receiving system compares that timestamp with its own and based on that it can determine the reachability of that transmitter lamp as follows:

a. If the timestamp from the receiver is "newer" than that of the transmitter (taking into account some delays and known offsets), it means that the transmitter lamp has been turned off b. If the timestamp from the receiver is "older" than that of the transmitter, it means that the receiver lamp has been turned off c. If the timestamp of both transmitter and receiver lamps are roughly similar, but either one cannot be communicated with, then it means that it is out of reach as opposed to being turned off (and therefore assumed to be stuck on the last known illumination setting).

As a second example, a "last gasp" method can be used: each lamp 5 has special circuitry to very quickly determine if its power source has been removed (either mains, battery, or other) and a mechanism to store energy for a limited amount of time after this power source is removed. When the circuit detects the power out, the remaining stored energy is used to send an immediate, high priority message ("last gasp message") into the network informing that it is being powered off. This message is picked up by either a central controller (such as the bridge 10) directly or passed along via intermediate nodes until it reaches the controller 10. This message is the element that allows to determine the reachability of a lamp as follows:

a. If the controller determines that a lamp cannot be communicated with but it has received this "last gasp" message, it knows that it is powered off;

b. If the controller determines that a lamp cannot be communicated with but it has not received this "last gasp" message, it assumes that the lamp has gone out of range but it remains powered (and therefore assumed to be stuck on the last known illumination setting).

As a third example, neighbor information can be used: in most networks that have meshing capabilities each node has knowledge on which are the other nodes in its vicinity, by other intelligent routing of messages, measurement of RSSI (signal strength), etc. When a lamp 5 is deemed unreachable by the central controller 10, the controller can start polling the lamps in the vicinity of the missing one to check for their respective history/log of neighboring lamps. The following might happen:

a. The neighboring lamps all detected that the missing lamp disappeared at (roughly) the same time. This would mean that the lamp was powered off;

b. The neighboring lamps saw the missing lamp disappear at different instants, or some see a gradual or partial degradation of signal strength. This would mean that there is either something blocking RF transmission (thus the gradual/partial degradation of signal strength), or that the missing lamp has been moved from location (thus some lamps seeing it disappear sooner than others). This means that the lamp is unreachable and not powered off (and therefore assumed to be stuck on the last known illumination setting).

As will be appreciated, these techniques are exemplary, and provided herein for the purposes of illustration only. There are other techniques that can be used to distinguish between a lamp that is off and a lamp that is stuck on a particular illuminations setting in the present context, as will be apparent to the person skilled in the art.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lighting control apparatus comprising:

a control interface configured to connect to a lighting system comprising one or more luminaires for illuminating an environment, each luminaire comprising at least one lamp controllable to emit configurable illumination;

a memory configured to store at least one set of configuration data for a group of lamps in the lighting system, the set of configuration data defining an initial lighting scene for rendering by the group of lamps;

a scene controller arranged for controlling the group of lamps, via the control interface, to render lighting scenes;

a detector configured to detect when at least one lamp of the group of lamps is emitting illumination that would disrupt the initial lighting scene by detecting when the at least one lamp of the group of lamps is uncontrollable by the scene controller, and via the control interface that the at least one lamp of the group of lamps has become unreachable, and determine at least one characteristic of the disruptive illumination by accessing in the memory a last-known illumination setting of the at least one lamp of the group of lamps; and a scene modifier configured to modify the set of configuration data based on the determined characteristic to account for the disruptive illumination, such that an overall illumination of the environment when rendering the modified scene at least approximately matches an overall illumination of the environment that would have been provided had it been possible to render the initial scene without the disruptive illumination;

wherein the scene controller is configured to control one or more lamps of the group of lamps, via the control interface, to render a modified lighting scene defined by the modified set, wherein controlling the one or more lamps of the group of lamps comprises adjusting the illumination of the one or more lamps of the group of lamps other than the at least one lamp of the group of lamps which is uncontrollable by the scene controller.

2. A lighting control apparatus according to claim 1 comprising a scene creator configured to allow a user to create, via a user interface, the set of configuration data in the memory.

3. A lighting control apparatus according to claim 1, wherein the determined characteristic comprises a brightness and/or a color characteristic of the disruptive illumination, and the scene modifier is adapted to change a brightness and/or a color characteristic of the illumination of at least one other lamp that is in the group.

4. A lighting control apparatus according to claim 3, wherein the color characteristics comprise a color tone and/or a color temperature of the illuminations respectively.

5. A lighting control apparatus according to claim 3, wherein the set of configuration data defines a time-varying effect to be rendered by at least the other lamp, and the scene modifier is adapted to modify the time-varying effect to account for the disruptive illumination.

6. A lighting control apparatus according to claim 1, wherein the scene modifier is adapted to store the modified set in the memory, whereby the set which defines the initial scene is retained in the memory in an unmodified form.

7. A lighting control apparatus according to claim 6, wherein the detector is configured to detect when the at least one lamp of the group of lamps ceases to emit the disruptive illumination, and the scene controller is configured, in response, to access the unmodified set of configuration data and control the group of lamps to render the initial lighting scene.

8. A method of controlling a lighting system comprising one or more luminaires for illuminating an environment, each luminaire comprising at least one lamp controllable to emit configurable illumination, the method comprising:

retrieving a set of configuration data from a memory, the set of configuration data for a group of one or more of the lamps in the lighting system, the set of configuration data defining an initial lighting scene for rendering by the group of lamps;

detecting when at least one of the lamps in the lighting system is emitting illumination that would disrupt the initial lighting scene, by detecting when at least one lamp of the group of lamps is uncontrollable by the scene controller, and via the control interface that the at least one lamp of the group of lamps has become unreachable;

determining at least one characteristic of the disruptive illumination by accessing in the memory a last-known illumination setting of the at least one lamp of the group of lamps; and modifying the set of configuration data based on the determined characteristic to account for the disruptive illumination, such that an overall illumination of the environment when rendering the modified scene at least approximately matches an overall illumination of the environment that would have been provided had it been possible to render the initial scene without the disruptive illumination; and controlling one or more lamps of the group of lamps, via the control interface, to render a modified lighting scene defined by the modified set, wherein controlling the one or more lamps of the group of lamps comprises adjusting the illumination of the one or more lamps of the group of lamps other than the at least one lamp of the group of lamps which is uncontrollable by the scene controller.

9. A computer program product comprising executable code stored on a computer-readable storage medium and configured when executed to implement the method or functionality of the apparatus of claim 1.

* * * * *